United States Patent [19]

Koller

[11] 4,364,216

[45] Dec. 21, 1982

[54] STRUCTURAL UNIT IN THE FORM OF A PROFILED BAR

[76] Inventor: Ernst Koller, Paradiesstrasse 64, CH-4102 Binningen, Switzerland

[21] Appl. No.: 124,458

[22] Filed: Feb. 25, 1980

[30] Foreign Application Priority Data

Nov. 17, 1979 [CH] Switzerland ..... 10231/79
Dec. 19, 1979 [DE] Fed. Rep. of Germany ..... 2951068

[51] Int. Cl.[3] ..... E04C 3/30

[52] U.S. Cl. ..... 52/731; 52/732; 52/738

[58] Field of Search ..... 52/730, 731, 738, 732, 52/727

[56] References Cited

U.S. PATENT DOCUMENTS

| | | | |
|---|---|---|---|
| 3,043,408 | 7/1962 | Atwood | 52/78 X |
| 3,055,399 | 9/1962 | Bush et al. | 52/732 X |
| 3,490,800 | 1/1970 | Wissler | 52/730 |
| 3,703,063 | 11/1972 | Budich et al. | 52/727 |
| 4,065,904 | 1/1978 | Taylor et al. | 52/731 |
| 4,069,638 | 1/1978 | Hasselquist et al. | 52/731 |
| 4,126,978 | 11/1978 | Heller | 52/732 X |
| 4,194,338 | 3/1980 | Trafton | 52/738 X |

*Primary Examiner*—John E. Murtagh

*Assistant Examiner*—Carl D. Friedman

*Attorney, Agent, or Firm*—Ostrolenk, Faber, Gerb & Soffen

[57] ABSTRACT

The disclosure concerns a multipurpose structural unit for fastening parts of buildings, or the like, together. The unit comprises a longitudinally elongaged bar, which may be either solid or hollow and which may be comprised of various different materials. The bar has two opposite transverse sides and two opposite end sides which joint the transverse sides. At least one longitudinal groove is defined in each transverse side of the structural unit, and a longitudinal groove may also be defined in each end side of the structural unit. The surfaces between the edge of the groove in the transverse side and the end side of the structural unit slant obliquely inwardly toward the center of the structural unit, whereby the structural unit has a generally octagon shaped exterior profile or cross-section. The cross-section shapes of the longitudinal grooves are disclosed. Various possible inserts and configurations for using the structural unit in combination with other structural elements and parts are disclosed, principally through insertion of the margins of the various structural elements and parts into the grooves in the structural unit.

25 Claims, 4 Drawing Figures

FIG.1
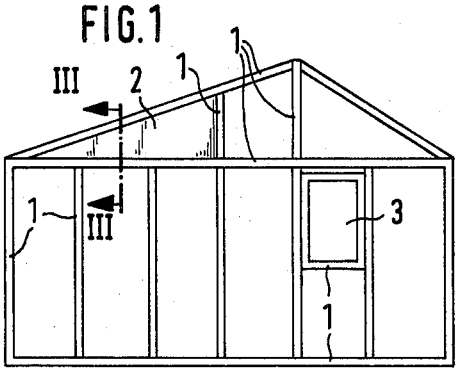
FIG.3
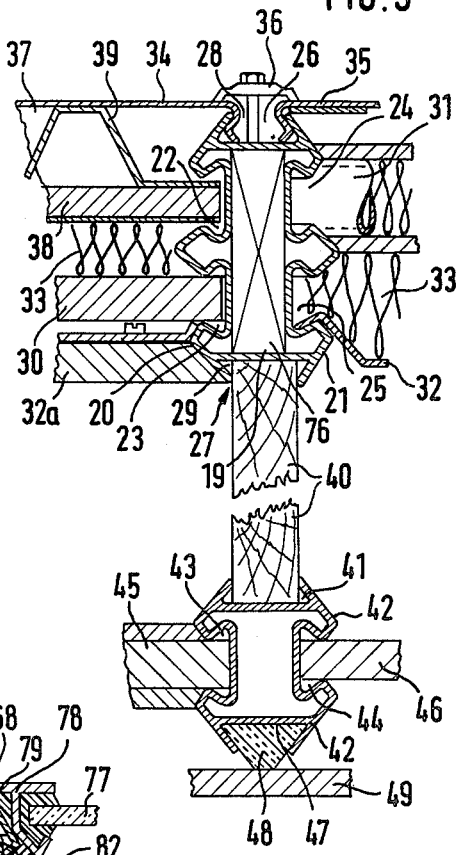
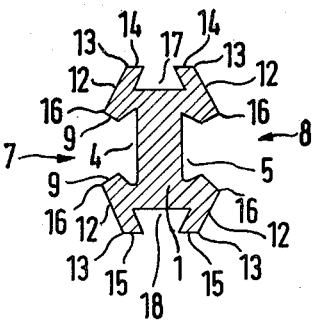
FIG.2
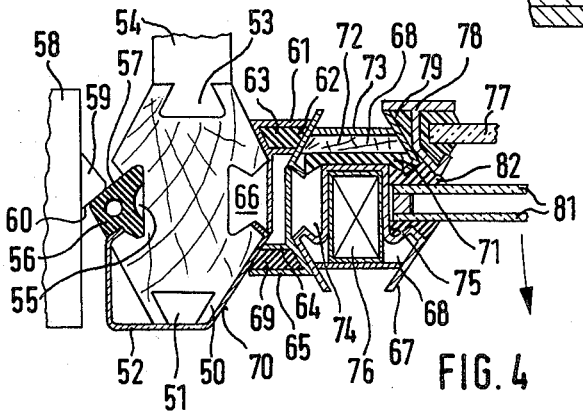
FIG.4

STRUCTURAL UNIT IN THE FORM OF A PROFILED BAR

BACKGROUND OF THE INVENTION

The present invention relates to a structural unit, which is profiled and is in the form of a bar, and which structural unit is intended particularly for fastening together of building parts. The bar has at least one longitudinal groove on each of two opposite, transverse sides. Two opposite, end sides connect the transverse sides together. The transverse sides and the end sides which directly adjoin each other form longitudinal edges.

Austrian Pat. No. 328,694 discloses a hollow, column-shaped, metallic structural unit having a hexagonal cross-section. A longitudinal groove is provided at each corner. The groove consists of an outer parallel section and a widened channel section lying behind the parallel section. Arms provided with two wings bent at an angle can be inserted into the widened channel section of the longitudinal groove. These wings lie against outer sides of the structural unit and can be screwed firmly to it. Wall elements can be arranged on the arms. This known structural unit can be used essentially only as a column. Neither doors nor windows can be constructed by using it. Furthermore, installation of locks, or the like, is not possible as long as the structural unit is of a usable size.

DE-OS (German Unexamined Application for Patent) No. 1,693,091 describes metallic, hollow-shaped bars for forming frames for windows, doors and glass walls. Each bar has a longitudinal groove along each of its two opposite side surfaces. The longitudinal grooves widen toward the center of the shaped bars so that sealing strips, door strips and holders for window panes can be anchored in the grooves. These known shaped bars are of limited utility, in the same way as the structural elements known from Austrian Pat. No. 328,694. Similarly shaped bars are also shown in German Pat. No. 1,683,699 and in German Utility Model 1,986,177. One essential disadvantage of all of the above mentioned special shape bars is that they cannot be employed in diverse uses. Furthermore, gaps result when the sides of these bars are placed against walls since the walls are frequently rough and uneven. Sealing is also difficult.

SUMMARY OF THE INVENTION

The present invention is directed toward so shaping the above type of a structural unit that it can have diverse uses, without the need for additional means. In particular, identical structural units are intended to be useful for the vertical or horizontal margins of solid or movable wall-boards and for their connection to other elements. Furthermore, similar structural elements, possibly of different size, are also intended to be suitable for forming muntins, casings, window frames, casement frames and door frames.

According to the invention, the opposite transverse sides of the structural unit have outer surfaces, that are oriented oblique to each other and that are located alongside both sides of the longitudinal grooves formed in the transverse sides. The outer surfaces are inclined inwardly toward the center of the structural unit from the grooves in the transverse sides to those longitudinal edges of the structural unit which are formed at the intersections between the outer surfaces and the end sides. The structural unit has an increasingly greater thickness moving in the direction from the end sides toward the longitudinal grooves. The external profile of the structural unit, or the structural unit viewed in cross-section, defines an octagon.

The invention thus provides a structural unit which is both simple and has many possible uses.

As compared with known structural units in the form of specially shaped bars, substantial advantages are obtained with the invention. The structural unit of the invention has many diversified uses. The bar is torsionally rigid. It can be made of wood, metal, steel, aluminum or plastic, can be comprised of one or more parts, and can be either tubular or solid. With the same shape of structural units, it is possible to produce columns, girders, muntins, roof trusses, facades, solid and movable walls, casings, frames, normal and insulated windows, doors and gates having the most varied types of openings and with simple or multiple glazing. The structural unit of the invention requires for this only relatively small cross-sectional dimensions. The shape of the structural unit enables corresponding structural parts to be connected with the structural unit without the overall width of the resulting assembly being normally wider than the structural unit itself. This is true even in the case of quadruply glazed windows and doors, as will be evident from the following detailed description. Because there are so many possible uses for structural units of the same special shape, simplified planning, storing, techniques of manufacture and assembly, as well as corresponding reductions in cost, are all obtained.

Other objects and features of the invention will be apparent from the following description and the accompanying drawings.

BRIEF DESCRIPTION OF THE DRAWINGS

FIG. 1 is a side view of a building wall with roof trusses, in which the individual parts are held together by structural units in accordance with the invention;

FIG. 2 is a vertical cross-section through an embodiment of a structural unit in accordance with the invention;

FIG. 3 is a vertical cross-section along the line III—III of FIG. 1, showing two other embodiments of structural units in accordance with the invention; and FIG. 4 is a horizontal cross-section through two other embodiments of structural units of different size in accordance with the invention, used as framing for a door or a casement window.

DESCRIPTION OF THE PREFERRED EMBODIMENT

In all embodiments, the structural unit of the invention has two opposite transverse sides, and two end sides join the transverse sides. The transverse and end sides are each generally in one of four respective planes, and the four planes preferably intersect at right angles. The transverse sides have outer surfaces near the respective intersecting end sides and the outer sides are oriented obliquely to each other. This gives the structural unit of the invention an external or cross-sectional contour in the shape of an octagon.

FIG. 1 shows one of the many possible uses for the structural unit of the invention. A bungalow wall with roof trusses and a skeleton construction is shown. It is formed of axially elongated structural units 1 having a bar shape in accordance with the invention. A truss reinforcement 2, which is inserted in the below described grooves 4 and 5 of the structural units 1, also forms an upper horizontal wall termination. The frame and sash for a window 3 are also constructed using the structural elements in accordance with the invention.

FIG. 2 shows an embodiment of the structural element 1. The element 1 has longitudinal grooves 4 and 5 extending longitudinally along the opposite transverse sides 7 and 8. The longitudinal grooves 4 and 5 widen toward the center of the structural unit 1. Thus, the base of each groove is trapezoidal in shape. The longitudinal grooves 4 and 5 also widen toward the outside of the grooves as is shown by groove sections 9. The side walls of the grooves and 5 first converge and at section 9, the side walls simply reverse their inclination and diverge. The effect is to make the outward side of the grooves wider than their base portion.

Along the transverse sides 7 and 8, alongside the grooves 4 and 5, the transverse sides are oblique to each other at outer surfaces 12; moving toward end sides 14 and 15 of the unit. The outer surfaces 12 extend obliquely between the longitudinal edges 13 of the two opposite, parallel end sides 14 and 15 of the bar and the longitudinal grooves 4 and 5. The outer surfaces 12 are preferably flat. Together with the outer ends of the side walls of the longitudinal grooves 4 and 5, the surfaces 12 form essentially sharp-edged, longitudinal edges 16 at which the structural unit 1 has its greatest width. It is apparent that the surfaces 12 and the sides 14, 15 together define an octagonal peripheral profile for the structural element 1.

It is advantageous for many uses of the structural units to provide at least one lengthwise extending longitudinal groove 17 and/or 18, respectively, on the end sides. The grooves 17, 18 are preferably identical to each other; and preferably have the illustrated trapezoidal cross-section, i.e. a cross-section which widens toward the middle of the bar shaped unit 1. The side walls of the grooves 17 and 18 preferably extend parallel to the respective, adjacent oblique bar outer surfaces 12. In other embodiments, it is possible to develop the longitudinal grooves 17 and 18 to be similar to or identical to the longitudinal grooves 4 and 5.

As already mentioned, the structural units in accordance with the invention may be fabricated from wood, metal or plastic. Solid material is preferred in the case of wood units, and tubular material in the case of metal units. Combinations of metal and wood are preferred for certain uses, as will become evident from the description of the following embodiments.

FIG. 3 shows another structural unit 19 in accordance with the invention, similar to that of FIG. 2 in use. It is a tubular, metal, profile unit, comprised, for instance, of aluminum or steel. On each of its transverse sides 20 and 21, there are two laterally spaced apart, longitudinal grooves, viz. 22 and 23 on side 20 and 24 and 25 on side 21. On the end sides 26 and 27 of the structural unit 19, respective longitudinal grooves 28 and 29 are formed. These are analogous to grooves 17 and 18, respectively.

FIG. 3 shows diverse possible uses for structural units in accordance with the invention. For example, an intermediate slab 30, with which a ceiling board 32*a* is engaged, is inserted into the lower lateral longitudinal groove 23 at one transverse side of the structural unit. In the upper lateral longitudinal groove 24 on the other side of the structural unit, a transverse reinforcement 31 is inserted. The lower lateral longitudinal groove 24 on the other side engages a ceiling board 32, together with insulating material 33. Into the upper end-side longitudinal groove 28, roof slabs 34 and 35 are engaged, via corresponding bends. The upper longitudinal groove 28 can serve as a water discharge off the roof. By means of suitable holding members, cover rails or clamps 36, the slabs placed on the end side 26 are screwed or clamped in the longitudinal groove 28. The roof slabs 34, generally of sheet metal or plastic, can be stiffened by transverse ledges 37, ribbed members 38, or corrugated plates 39.

A plate 40 has an upper edge that is inserted into the lower end longitudinal groove 29 of the structural element 19. The plate has a lower edge that is inserted into an upper end-side longitudinal groove 41 of another structural unit 42, which is another embodiment in accordance with the invention. The plate 40 corresponds to the plate 2 in FIG. 1 and serves both for reinforcing the roof truss and as a wall termination. Respective cover plates 45 and 46 are inserted into the lateral side longitudinal grooves 43 and 44 of the structural unit 42. In a lower end side longitudinal groove 47 of the lower structural element 42, an insulating member 48 is inserted. Inner boards or an inner facing 49 which has a moisture barrier rests against the member 48. The insulating member 48 is so dimensioned that between the structural element 42 and the inner facing 49, there is a space which prevents the transmission of cold. The free-space insulation can also be arranged on the outside, depending on the board selected, the outer facing and the K value, with or without external aeration of outer walls or roof constructions. In the case of a bungalow, emergency accommodations, and the like, the so-called breathing of the walls need not be taken into consideration if good short ventilation (preferably cross ventilation) of the room in question is possible and the moisture barrier lies behind the first inner board. With this type of construction, the greatest amount of energy is saved. Because of the diversified uses of the structural units of the invention, the most suitable and most favorably priced structures can be erected, depending on the climatic zone, always using the same manufacturing technique.

FIG. 4 shows further uses of different structural units in accordance with the invention. Here a larger and stronger structural unit 50 in accordance with the invention, e.g. of wood, is used as a column or casing. Wood does not warp as much as metal under the action of heat, while metal is fireproof. The appropriate material is selected for a structural unit to suit the particular application. The structural unit is provided on the outside, i.e. at the lower end side 51 in FIG. 4, with any desired shape covering member 52 of metal, preferably steel or aluminum, in order to provide greater resistance to weather, sound, and fire. The protective outer shaped member 52 could, however, also consist of plastic. In the longitudinal groove of the inner end side 53, i.e. that end at the top in FIG. 4, a plate 54 is anchored.

FIG. 4 now shows two other advantageous variants for door and window frames. A shaped molding 56 of elastic material, for instance of rubber or neoprene, is contained in a lateral longitudinal groove 55 of the larger structural unit 50. The molding 56 has an oblique stop surface 57. On a door 58, with which the molding cooperates, there is a stop 59 having a beveled surface 60 which rests in sealing fashion against the oblique stop surface 57 of the shaped molding 56 when the door 58 is closed. The frame of the door 58 can also have the form of the structural unit 50. In that case, the oblique stop surface 60 can be developed similarly to the oblique stop surface 57 by an elastic, shaped member, which is placed into a lateral longitudinal groove of this structural unit. By such a simple arrangement, which results in a tight closure, the previously customary multiple step-shaped sectional members can be avoided, as they take up a large amount of space.

On that transverse side of the structural unit 50 which is to the right of FIG. 4, a longitudinally extending stop member 61 is fastened. It has a generally U-shaped end groove which opens to the right. Into the end groove 62, an elastic sealing element 63 is inserted. A similar longitudinally extending stop member 64 has a U-shaped end groove 65. The stop member 64 is arranged on a shaped member 67 of a separate structural unit 68, which is also developed in accordance with the invention. Within its end groove 65, the stop member 64 has an elastic sealing member 69, which cooperates with an oblique side surface 70 of the structural unit 50. Thus, the invention not only permits two multiply sealing oblique surface stops, but also, with the same construction, permits doors and windows which open toward the outside or the inside to be erected.

The shaped member 67 is a hollow section of metal, which is connected via an insulating intermediate layer 71 with a shaped wooden strip 72. The wooden strip 72 can be covered on its outer side with a shaped member 73, which is plastic or preferably metal. The hollow member 67 and the wooden strip 72 together form the structural unit 68 of the invention. The unit 68 has lateral longitudinal grooves 74 and 75. As is shown also in FIG. 3, in connection with the structural unit 19, a wood strip or a steel pipe 76 for serving as a reinforcement or stiffening means, can also be inserted into the hollow member 67.

On the right in FIG. 4, at the members 67 and 72 of the trapezoidal structural unit 68, insertion of panes of glass is suggested. A pane of glass 77 is inserted in a frame 78 of wood, metal or plastic, using ordinary fastening means, such as putty. The pane frame 78 is placed on the upper oblique outer surface 79 of the wooden strip 72 so that the entire width of the frame, which consists of the elements 68 and 78, is not substantially greater than the width of the structural unit 68 by itself.

In the right side lateral longitudinal groove 75 of the structural unit 68, an insulating glass pane 81 comprised of two individual panes can, for instance, be inserted. Another glazing corresponding to the pane 77 can be arranged on the outside, i.e. in the bottom in FIG. 4, in a mirror-image arrangement with respect to the window 77, 78. Thus, it is possible in a simple and space-saving manner, for instance, to produce a quadruple glazing. A single elastic profiled member 82 can serve to hold the pane of insulating glass 81 fast and to seal it off from the frame 78 of the pane 77.

In the structural units of the invention, the longitudinal grooves provided on the transverse sides and the longitudinal grooves provided on the end sides are preferably in each case arranged in the centers of the side in question.

It is particularly advantageous, furthermore, to use the same shape structural units in different sizes, as required. Although the dimensions in themselves may be any desired ones, they are preferably selected in such a manner that in each case, smaller structural units in accordance with the invention can be inserted into larger size, hollow structural units. In this way, a saving in storage and transportation costs is obtained.

The drawings show diverse possible uses of structural units of shaped bar form in accordance with the invention. With some varients, fixed structural units having several walls or glass panes can be assembled. Further, there is a possibility of providing multiply sealing oblique stops. In this connection, the outer surfaces, which are oblique with respect to each other and extend obliquely to the end sides, play a particular role. In the structural units of the invention, the transverse sides are generally wider than the end sides. The outer longitudinal edges can be fitted substantially better to ceilings, walls, or the like than can flat surfaces. As a whole, it can be said that with the development of the structural unit in accordance with the invention, the same effect is obtained as was possible heretofore only by combining a plurality of individual known special shape structural units. Of particular advantage is the amazing simplicity and at the same time diversified utility of the structural unit of the invention. As shown above, many variants and combinations using shaped parts of wood, metal and plastic are possible, so that both better protection and better rigidity and a more pleasant appearance result. By insertion of rubber, sealing and insulating material at desired points, increased acoustic and heat insulation properties are obtained.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A structural element in the form of a shaped bar for attaching building parts and the like, having at least four longitudinal grooves which are arranged 90° apart on its periphery, of which grooves each of two longitudinal grooves arranged opposite each other has an outer section which becomes narrower trapezoidally from the outside to the inside and an inner section adjoining same which becomes wider from the narrowest point of the groove towards the inside, the base surface and the side surfaces of each of said longitudinal grooves being substantially flat and extending parallel to the corresponding surfaces of the other longitudinal groove arranged opposite same, the other two longitudinal grooves arranged 90° from the first mentioned two longitudinal grooves having a cross-sectional shape which becomes trapezoidally larger from the outside to the inside, the base surface and side surfaces of each of the said other two longitudinal grooves extending parallel to the corresponding surfaces of the other said longitudinal groove opposite same, said structural element having four flat outer surfaces which lie between the four longitudinal grooves and extend crosswise parallel to each other and four additional surfaces each extending between a boundary of a groove and one of said four flat outer surfaces the distance between diagonally opposite additional surfaces being greater than the distance between the first mentioned flat surfaces.

2. The structural unit of claim 1, wherein the groove side walls at the first portion of the groove incline obliquely outwardly.

3. The structural unit of claim 1, wherein the end side longitudinal groove side walls are inclined so that the respective one of those side walls nearer to one of the outer surfaces is at least approximately parallel to that outer surface to which it is near.

4. The structural unit of claim 1, wherein the structural unit is comprised of two longitudinally separated parts which are held together.

5. The structural unit of either claim 1, wherein the unit is hollow longitudinally, and is comprised of a profiled length of material which is deformed to define the grooves and the outer surfaces of the structural unit.

6. The structural unit of claim 5, further comprising a reinforcement inserted into the hollow of the structural unit.

7. The structural unit of claim 1, wherein the structural unit is comprised of two longitudinally separated parts which are held together.

8. The structural unit of claim 1, further comprising an insulating member inserted in at least one of the grooves and being generally shaped to match the groove in which it is inserted.

9. The structural unit of claim 1, wherein there are at least two of the longitudinal grooves, laterally spaced apart, on at least one of the two opposite sides of the structural unit.

10. The structural unit of claim 1, further comprising a generally flat object extending into at least one of the grooves.

11. The structural unit of claim 1, wherein the structural unit is covered, at least in part, by a shaped covering member.

12. The structural unit of claim 11, wherein the covering member is comprised of metal.

13. The structural unit of claim 1, wherein the structural unit is a solid bar.

14. The structural unit of claim 13, wherein the structural unit is comprised of wood.

15. The structural unit of claim 1, wherein the structural unit is comprised of two longitudinally separated parts which are held together.

16. The structural unit of claim 15, further comprising insulating material positioned between the separated parts of the structural unit.

17. The structural unit of claim 1, further comprising a second structural part for cooperating with the structural unit, and the second structural part being supported at least to one of the outer surfaces of the structural unit.

18. The structural unit of claim 17, wherein for supporting the second structural part to the structural unit, a respective sealing shaped member is provided on each of the structural unit and the second structural part, and each sealing shaped member extending from the one of the structural unit and the second structural part on which it is provided, toward the other of the structural unit and the second structural part and being interconnected.

19. The structural unit of claim 18, wherein each sealing shaped member is generally U-shaped, opening toward the other of the structural unit and the second structural part to which the sealing shaped member extends; a respective insert being provided in each U-shaped sealing member.

20. The structural unit of claim 19, wherein each insert is of elastic material.

21. The structural unit of either of claims 18 or 20, wherein one of the sealing shaped members is provided at one of the outer surfaces of the structural unit, and the other sealing shaped member extends to the other outer surface of the structural unit on the same transverse side of the structural unit.

22. The structural unit of either of claims 1 or 17, wherein in one of the longitudinal grooves of the structural member, a shaped stop member is provided, said stop member including an obliquely inclined stop surface which surface is oblique to the adjacent side of the structural unit and which extends out beyond that side.

23. The structural element according to claim 1, characterized by the fact that the outer ends of the side surfaces of the outer sections of the first mentioned two longitudinal grooves which become narrower from the outside to the inside intersect with the outer surfaces of the structural member adjacent said grooves and form edges which are parallel to each other.

24. A structural element according to either claim 1 or 23, characterized by the fact that at least some of the said outer surfaces of the building elment are planar.

25. The structural unit of claim 24, wherein at least one longitudinal groove includes a third portion defined by the side walls of the groove, which widens toward the center of the structural unit and which is deeper in the groove than the second portion of the groove.

* * * * *